US007421951B2

(12) United States Patent
Genis et al.

(10) Patent No.: US 7,421,951 B2
(45) Date of Patent: Sep. 9, 2008

(54) PIEZOELECTRIC STUN PROJECTILE

(75) Inventors: Vladimir Genis, Warminster, PA (US); Alexandre Soukhomlinoff, Passaic, NJ (US); Irina Khomchenko, Passaic, NJ (US)

(73) Assignee: Drexel University, Philadelphia, PA (US)

( * ) Notice: Subject to any disclaimer, the term of this patent is extended or adjusted under 35 U.S.C. 154(b) by 0 days.

(21) Appl. No.: 11/292,022

(22) Filed: Dec. 1, 2005

(65) Prior Publication Data

US 2006/0162605 A1 Jul. 27, 2006

Related U.S. Application Data

(60) Provisional application No. 60/632,162, filed on Dec. 1, 2004.

(51) Int. Cl.
*F42B 30/02* (2006.01)

(52) U.S. Cl. ..... 102/502; 361/232

(58) Field of Classification Search ..... 102/502, 102/501, 293, 512; 361/232; 42/1.08; 463/47.3; 89/1.11, 1.1
See application file for complete search history.

(56) References Cited

U.S. PATENT DOCUMENTS 5,698,815 A 12/1997 Ragner
5,786,546 A 7/1998 Simson
5,962,806 A 10/1999 Coakley et al.
6,283,037 B1 9/2001 Sclafani
6,679,179 B1 1/2004 Bohl et al.
6,679,180 B2 1/2004 Warnagiris et al.
6,802,261 B2 10/2004 Warnagiris et al.
6,802,262 B1 10/2004 Warnagiris et al.
6,880,466 B2 * 4/2005 Carman ..... 102/502
7,096,792 B1 * 8/2006 Carman ..... 102/502
7,100,514 B2 * 9/2006 LeBourgeois ..... 102/502

FOREIGN PATENT DOCUMENTS

GB 2384042 A * 7/2003
JP 2003042695 A * 2/2003
WO WO 2005/047802 8/2004

* cited by examiner

*Primary Examiner*—James S Bergin
(74) *Attorney, Agent, or Firm*—Knoble, Yoshida & Dunleavy, LLC

(57) ABSTRACT

The present invention provides a non-lethal projectile for delivering an electric pulse to a target. In one aspect of the invention, the projectile utilizes a piezoelectric device and an electrical oscillating circuit in order to generate a pulse. In another aspect of the invention, the projectile utilizes a piezoelectric device and a mechanical oscillating circuit in order to generate an electric pulse. Since the projectile of the present invention contains the structure to generate the required electric pulse, it can be employed effectively at distances of up to 150 meters.

12 Claims, 4 Drawing Sheets

30

100

PIEZOELECTRIC STUN PROJECTILE

CROSS-REFERENCE TO RELATED APPLICATIONS

This application claims the benefit of U.S. Provisional patent application No. 60/632,162, filed on Dec. 1, 2004, under 35 U.S.C. §119(e).

BACKGROUND OF THE INVENTION

1. Field of the Invention

The present invention relates to a non-lethal stun projectile that relies on an electrical impulse to stun the target. More specifically, the present invention relates to a self-contained, non-lethal piezoelectric stun projectile.

2. Description of the Prior Art

Non-lethal neuromuscular disrupter weapons, sometimes referred to as "stun guns", use a handpiece to deliver a high voltage charge to a human or animal target. The high voltage causes the target's muscles to contract uncontrollably, thereby disabling the target without causing permanent physical damage.

The most well known type of stun gun is known as the TASER gun. TASER guns look like pistols but use compressed air to fire two darts from a handpiece. The darts trail conductive wires back to the handpiece. When the darts strike their target, a high voltage charge is carried down the wire. A typical discharge is a pulsed discharge at 0.3 joules per pulse.

Taser guns and other guns of that type (herein referred to as "neuromuscular disrupter guns" or "NDG's") are useful in situations when a firearm is inappropriate. However, a shortcoming of conventional NDGs is the need for physical connection between the projectile and the source of electrical power, i.e., the handpiece. This requirement limits the range of the NDG to about 20 feet.

One approach to eliminating the physical connection is to use an ionized air path to the target to create a conductive air path. For example, it might be possible to ionize the air between the handpiece and the target by using high-powered bursts or other air-ionizing techniques. However, this approach unduly complicates an otherwise simple weapon. An example of a NDG that uses conductive air paths to deliver a charge to the target is described in U.S. Pat. No. 5,675,103.

U.S. Pat. No. 5,698,815 describes a stun bullet that does not require a wired connection to the handpiece and which is designed to penetrate the skin of the target and deliver an electrical charge having a lower voltage and lower energy per pulse than typical stun guns. This stun bullet is provided with a battery or alternatively it may have a capacitor to temporarily store a charge delivered to the bullet just prior to firing. The range of this device is said to be well over 100 yards, but the dual dart electrodes must unwind from the bullet to be deployed, and subsequently penetrate the skin. Thus, these projectiles have some disadvantages resulting from the method of deploying the electrodes.

Another approach to providing an NDG that does not require an electrical connection between the handpiece and the projectile is described in U.S. Pat. No. 5,962,806. In this device, an electrical charge is generated within the projectile by means of a battery-powered converter housed within the projectile.

U.S. Patent Nos. 6,679,180; 6,802,261 and 6,802,262 each describe a tetherless neuromuscular disrupter gun employing a liquid-based capacitor projectile. In these patents, the projectile has an outer housing for the liquid and a capacitor is also located within the housing. The gun charges the projectile prior to discharge of the projectile from the gun. Upon impact, the liquid is discharged to deliver a single pulse with sufficient electrical charge to disrupt neuromuscular activity. These projectiles have a limited range of about 60 meters.

There remains a need in the art for a non-lethal approach to stunning or inhibiting a target that does not require electrical contact between the target and a hand-held apparatus, such as a stun gun. In addition what is needed is a single projectile, non-lethal approach to stunning or inhibiting a target that is not range-limited by wires coupled to darts, such as with a TASER, and that can be easily reloaded if an initial firing is unsuccessful.

SUMMARY OF THE INVENTION

Figure 1:
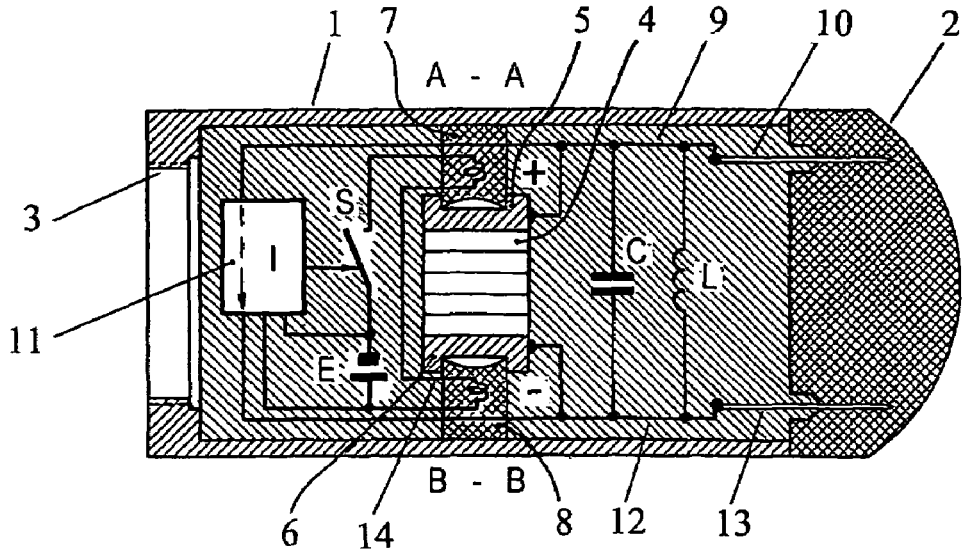
FIG. 1 is a diagram of the piezoelectric stun projectile with an electrical oscillating circuit.

The present invention provides a non-lethal projectile for delivering an electric pulse to a target that does not require electrical contact between the projectile and the hand held apparatus.

According to a first aspect of the invention, a projectile for delivering an electric pulse to a target is disclosed. The projectile has a housing; a piezoelectric element located within the housing; and an electrical oscillating circuit connected to the piezoelectric element.

According to a second aspect of the invention, a projectile for delivering an electric pulse to a target is disclosed. The projectile has a housing, a piezoelectric element located within said housing; and a stress spring, wherein compression of the stress spring completes a circuit that is connected to the piezeoelectric element.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE INVENTION

The term "piezoelectric" refers to a class of materials that generate an electrical charge when subjected to an applied force that produces stress or otherwise induces strain in the piezoelectric material. One common type of piezoelectric device is a pressure transducer.

Piezoelectric pressure transducers typically are exposed to a fluid medium which exerts pressure directly or indirectly upon a diaphragm that is mechanically coupled to the piezoelectric element in a manner that applies a force thereto. The applied force generates a stress and related strain in the piezoelectric material. The piezoelectric element responds to the applied force and strain by generating an electrical charge. The electrical charge is directed to poles of the piezoelectric element which have electrical leads connected thereto. Electrical circuitry detects this generated electric charge and derives an electric signal representative of the pressure within the fluid medium. One attribute of piezoelectric devices is that the amount of electrical charge is typically very low.

A piezoelectric stun projectile (PESP) is designed to incapacitate a target by generating a powerful electrical output pulse. The principle of operating a PESP is based on the phenomenon of the direct piezoelectric effect. The source of electrical energy is a piezoelectric element, which generates a short electrical pulse upon application of mechanical stress to the piezoelectric element. In the context of the present invention, the short electrical pulse of the piezoelectric element may be applied to an under-damped oscillating circuit, which generates an attenuated periodic signal for about 0.5-1 second. During this time interval, the amplitude of the generated voltage can reach tens of kilovolts.

In the device of the present invention, the source of the mechanical stress may be the energy of a direct internal controlled explosion in the projectile. The PESP of the present invention is thus able to generate a powerful impulse of electrical energy in the range of 1 to 300 joules, and has a distance-range of up to about 150 meters. To deliver the PESP of the present invention, to the target, conventional sources of mechanical energy could be used, such as pneumatic devices or other devices for delivery of projectiles.

A diagram of one embodiment of a PESP in accordance with the present invention is presented in FIG. 1. FIG. 1 depicts a PESP 30 provided with an electrical oscillating circuit. The housing 1 holds the components of the PESP 30 together. The housing 1 may be a single molded piece of high impact plastic or it may be any suitable casing material including a standard shell casing for a shotgun or M203grenade. The housing 1 has a nose tip 2 made of a material that shields the electrodes 10, 13, in this case conductive needles 10, 13, prior to discharge of the PESP 30. Nose tip 2 may be an energy-absorbing foam rubber, but any material may be used to fabricate nose tip 2, so long as the material can be compressed upon impact to allow the conductive needles 10, 13 to pierce through nose tip 2, once nose tip 2 of projectile 30 strikes a target.

A depression or hole 3 may be provided in the housing 1 for the purpose of assisting in deployment of the projectile 30 by a suitable deployment mechanism. Housing 1 also contains a piezoelectric element 4, located between a pair of metallic plates 5, 6. Explosive material 7, 8 is positioned adjacent to metallic plates 5, 6, such that detonation of explosive material 7, 8 will apply a force to metallic plates 5, 6 causing plates 5, 6 to compress piezoelectric element 4. Explosive material 7, 8 may be detonated upon impact of the projectile 30 with a target by electro-detonators 14.

When PESP 30 hits a target, the nose tip 2 is compressed and conductive needles, 10, 13, penetrate into the target thereby creating an electrical connection between conductive needles 10, 13. This electrical connection between conductive needles 10, 13, activates electronic device 11 to close switch S, connecting electro-detonators 14 to energy source E. This results in the substantially simultaneous explosion of explosive materials 7, 8. Explosion of explosive materials 7, 8 breaks wires 9, 12 along the lines A-A and B-B, respectively, thereby breaking the connection between conductive needles 10, 13 and electronic device 11. At the same time, the metal plates 5, 6 apply a force to piezoelectric element 4 to cause piezoelectric element 4 to generate an electric pulse. Also, piezoelectric element 4 is connected in parallel to the electrical oscillating circuit L, C and conductive needles 10, 13, via metal plates 5, 6, thereby transmitting the high voltage electric pulse from the piezoelectric element 4 to the target via electrical oscillating circuit L, C and conductive needles 10, 13.

Figure 2:
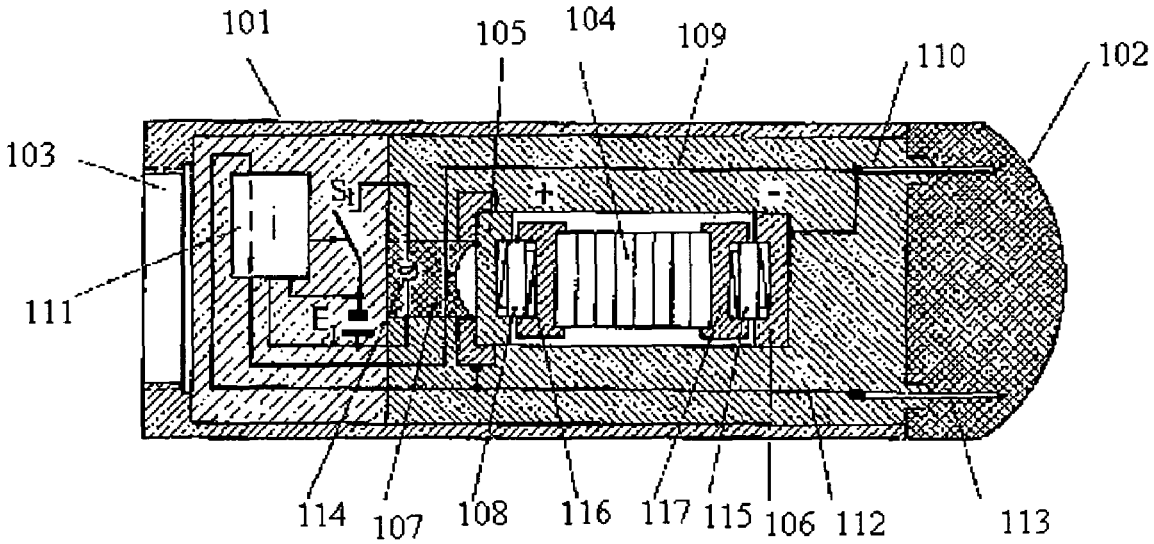
FIG. 2 is a diagram of the piezoelectric stun projectile with a mechanical oscillating circuit.

Turning now to FIG. 2, an alternative embodiment of the PESP of the present invention is shown. FIG. 2 shows a PESP 100 wherein a mechanical spring-mass system is used to create a harmonic mechanical stress on piezoelectric element 104, which will generate the high voltage electrical signal. FIG. 2 shows projectile body or housing 101, nose tip 102, hole or recess 103 that may be provided in the housing 101 for the purpose of assisting in deployment of the projectile 100 by a suitable deployment mechanism, piezoelectric element 104, metal plates 105, 106, propellant 107, flat springs 108, 115, electrical wires 109, 112, conductive needles or electrodes 110, 113, electronic device 111, electrodetonator 114, and metal plates 116, 117.

When PESP 100 hits a target, nose tip 102 is compressed and conductive needles, 110, 113, penetrate into the target thereby creating an electrical connection between conductive needles 110, 113. The impact with the target activates electronic device 111 to close switch $S_1$, connecting electro-detonator 114 to energy source $E_1$. This results in the explosion of propellant 107. As a result of the explosion, propellant 107, applies severe mechanical stress to springs 108, 115 causing springs 108, 115 to compress. The compression of stress springs 108, 115 results in the contact of metal plates 116, 117 with metal plates 105 and 106 thereby completing a circuit to allow an electric pulse generated by the force applied to piezoelectric element 104 to be transferred to the target via conductive needles 110, 113.

Figure 3:
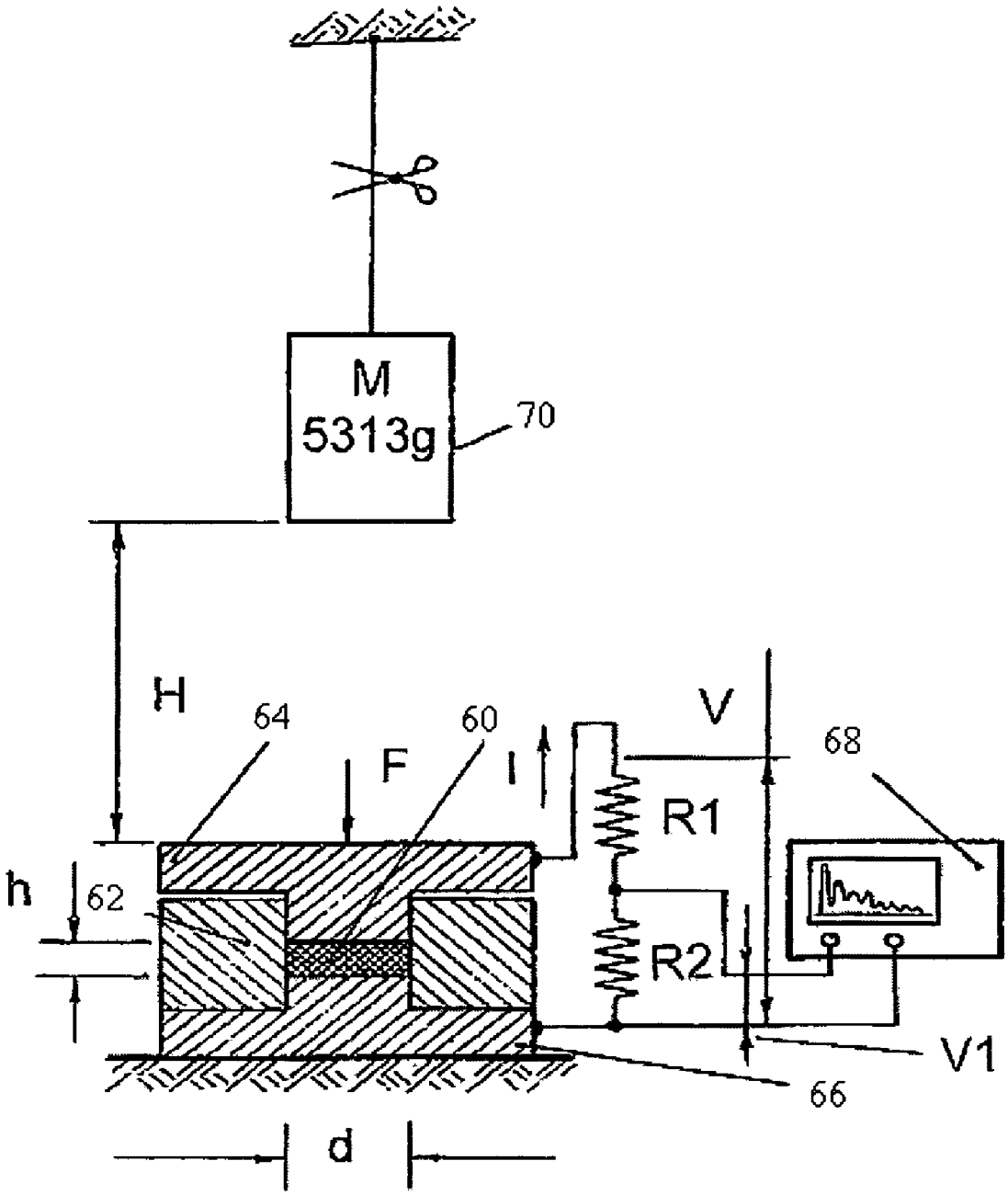
FIG. 3 is a schematic diagram of the experimental setup used to demonstrate the effectiveness of the piezoelectric element of the invention.
Figure 4:
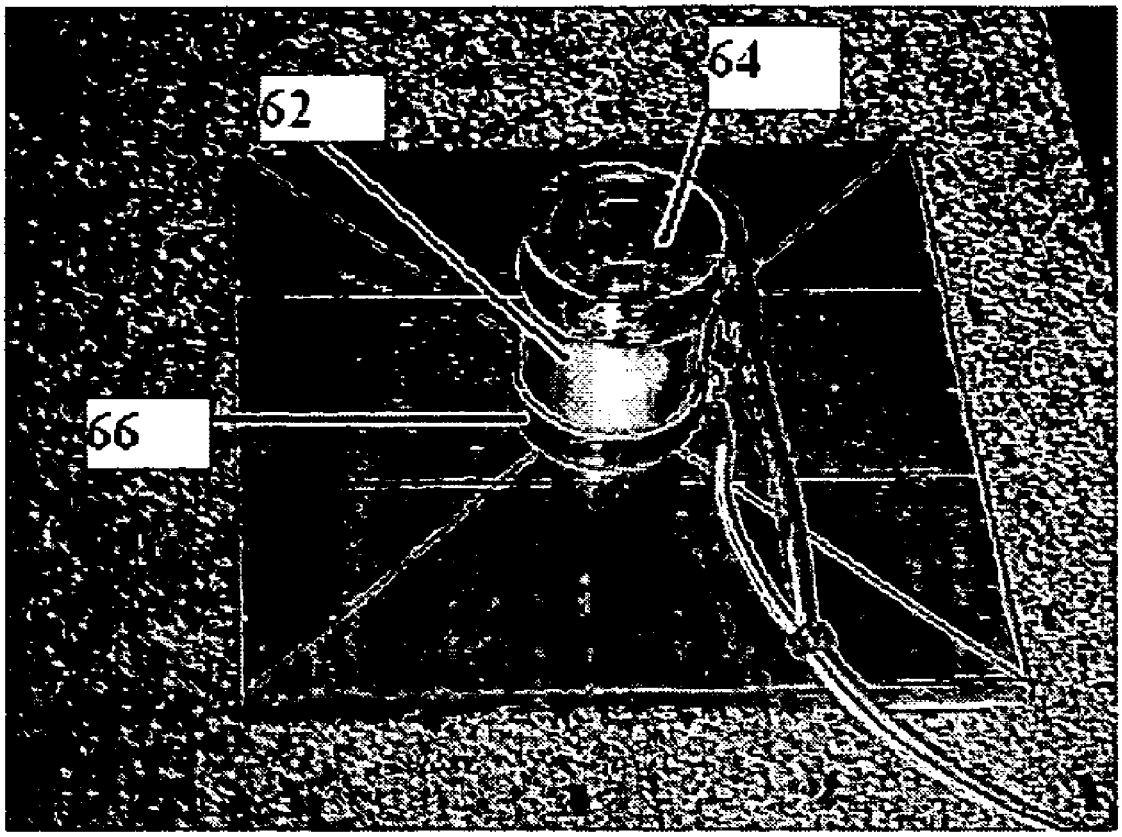
FIG. 4 is a photograph of the experimental device of FIG. 3.

FIG. 3 is a schematic diagram of an experiment conducted to demonstrate the usefulness of the present invention. The diagram shows piezoelectric element 60 with a height h and a diameter d, a holder 62, metal plates 64, 66 and an attached oscilloscope 68. Resisters R1 and R2 are shown as well as H, which represents the altitude from which a 5.313 kg object 70 was dropped, generating force F onto plate 64. In this experimental setup, a 5.313 kg object 70, was dropped on two circular piezoelectric disks the position of which is represented by piezoelectric element 60, mounted in a holder 62 between two metal plates 64 and 66. Each time the object 70 was dropped, the voltage was recorded by the oscilloscope using a voltage divider V and an attenuator V1 (10:1). The first piezoelectric element had a diameter (d) of 9.56 mm and a height (h) of 1 mm. The second one had a diameter (d) of 6.96 mm and a height (h) of 8.86 mm. FIG. 4 is a photograph showing the experimental apparatus of FIG. 3: holder 62 and the two metal plates 64, 66.

In the first experiment, the object was dropped from the altitude H of 1.08 m and the voltage divider V was constructed of two resistors, $R_1$=100 kΩ and $R_2$=3.3 kΩ. In the second experiment, the object was dropped from the altitude H of 1.75 m and the voltage divider V was constructed of two resistors, $R_1$=100 kΩ and $R_2$=1.5 kΩ. Recorded voltages for both experiments are presented in FIG. 5 (experiment 1) and FIG. 6 (experiment 2), respectively, as oscillograms.

Figure 5:
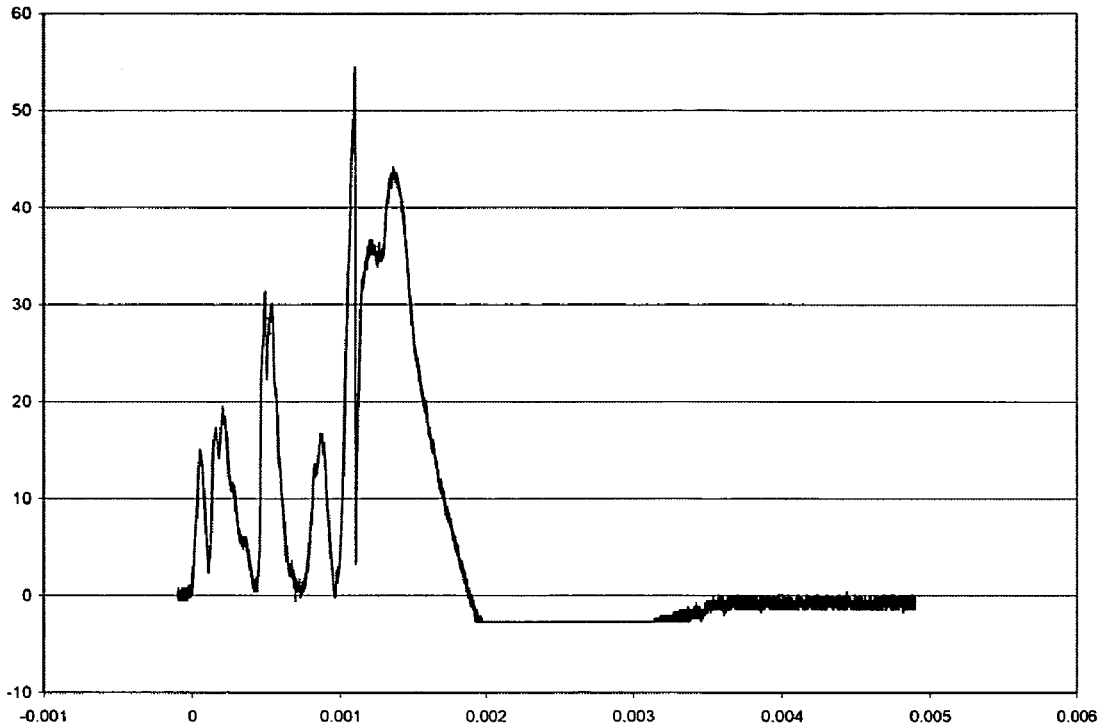
FIG. 5 is a graph of the voltage oscillogram for Experiment 1.
Figure 6:
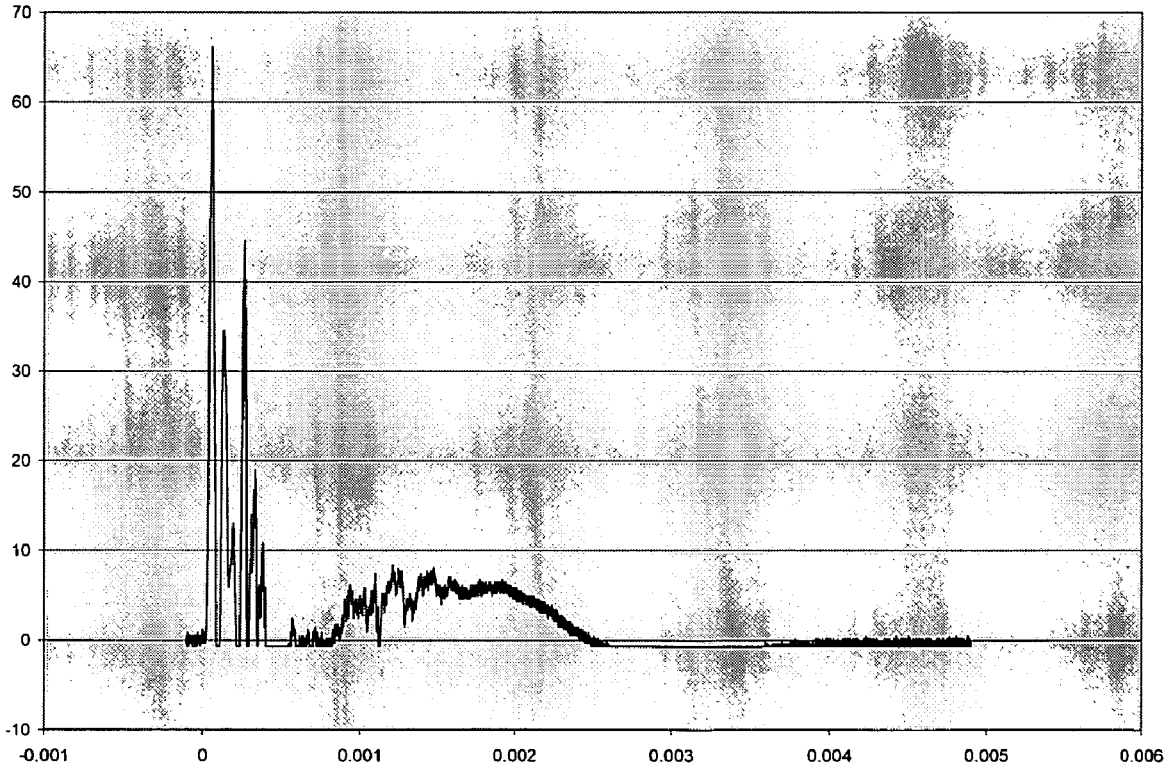
FIG. 6 is a graph of the voltage oscillogram for Experiment 2.

As can be seen from FIGS. 5 and 6, and accounting for the values of the resistors $R_1$ and $R_2$, as well as the attenuation coefficient of the attenuator, the voltage amplitudes in both experiments are 16.7 kV and 44.7 kV, respectively. Thus, this demonstrates that piezoelectric elements can effectively develop sufficient charge to disable a target by electric shock without the need for batteries or trailing wire.

What is claimed is:

1. A projectile for delivering an electric pulse to a target comprising:

a housing;

a piezoelectric element located within said housing;

an electrical oscillating circuit operatively connected to said piezoelectric element;

structure for applying a force to said piezoelectric element; and electrodes operatively associated with said structure to initiate application of force and to conduct electricity from said piezoelectric element to said target.

2. The projectile of claim 1, wherein said electrodes are positioned in a distal portion of said housing to create an electrical connection between said electrodes upon contact between said electrodes and a conductive body.

3. The projectile of claim 2,wherein said structure for applying a force to said piezoelectric element comprises:

a conductive plate located proximate to said piezoelectric element;

a propellant;

a detonator operatively associated with said electrodes and said propellant for detonating said propellant to apply a force to said conductive plate when said connecting between said electrodes is made.

4. The projectile of claim 3, wherein said propellant is an explosive material.

5. The projectile of claim 3,wherein said structure for applying a force further comprises an electronic device connected to said detonator to activate said detonator when said connection between said electrodes is created.

6. The projectile of claim 5, wherein said electrodes comprise conductive needles.

7. The projectile of claim 5, wherein said structure for applying a force further comprises a current switch operatively associated with said electronic device.

8. The projectile of claim 3 wherein said projectile has a range of greater than 100 meters.

9. The projectile of claim 3, wherein said projectile upon impact creates an impulse of energy in the range of 1 to 300 joules.

10. The projectile of claim 3, wherein said piezoelectric element is a sole power source of said projectile.

11. The projectile of claim 2, wherein said distal portion of said housing is compressible.

12. The projectile of claim 2, wherein said distal portion comprises a rubber material.

* * * * *